US010986887B1

(12) United States Patent
Kubasco

(10) Patent No.: US 10,986,887 B1
(45) Date of Patent: Apr. 27, 2021

(54) DETACHABLE ILLUMINATING COSTUME ACCESSORY

(71) Applicant: Rubies II, LLC, Westbury, NY (US)

(72) Inventor: Brian Kubasco, San Diego, CA (US)

(73) Assignee: Rubies II, LLC, Westbury, NY (US)

( * ) Notice: Subject to any disclaimer, the term of this patent is extended or adjusted under 35 U.S.C. 154(b) by 0 days.

(21) Appl. No.: 16/682,678

(22) Filed: Nov. 13, 2019

(51) Int. Cl.

| | |
|---|---|
| ***A41G 7/02*** | (2006.01) |
| ***F21V 23/04*** | (2006.01) |
| ***F21V 21/08*** | (2006.01) |
| ***F21V 3/00*** | (2015.01) |
| *F21W 121/06* | (2006.01) |
| *F21Y 115/10* | (2016.01) |

(52) U.S. Cl.
CPC ..... *A41G 7/02* (2013.01); *F21V 3/00* (2013.01); *F21V 21/0832* (2013.01); *F21V 23/04* (2013.01); *F21W 2121/06* (2013.01); *F21Y 2115/10* (2016.08)

(58) Field of Classification Search
CPC ..... A41G 7/02
USPC ..... 362/103–108
See application file for complete search history.

(56) References Cited

U.S. PATENT DOCUMENTS 4,683,588 A * 7/1987 Goldberg ..... A41G 7/02 2/410
4,690,653 A * 9/1987 Goldberg ..... A41G 7/02 2/173
5,479,325 A * 12/1995 Chien ..... A42B 3/044 362/105
6,035,447 A * 3/2000 Hsia ..... A41G 7/02 2/202
10,429,057 B1 * 10/2019 Templer ..... A41D 27/085
2002/0131266 A1 * 9/2002 Naghi ..... A44C 15/0015 362/104
2005/0018420 A1 * 1/2005 Parsons ..... A44B 15/005 362/190
2005/0068762 A1 * 3/2005 Post ..... A41D 27/085 362/105
2007/0189003 A1 * 8/2007 Daley ..... A41G 7/02 362/105
2011/0086716 A1 * 4/2011 Brockley ..... A63J 7/00 472/51
2018/0074351 A1 * 3/2018 Smoot ..... A42B 3/042

* cited by examiner

*Primary Examiner* — Andrew J Coughlin
*Assistant Examiner* — Keith G. Delahoussaye
(74) *Attorney, Agent, or Firm* — McCarter & English, LLP

(57) ABSTRACT

A detachable illuminating accessory for use in a mask or costume, and the associated mask or costume, in which the detachable illuminating accessory includes a top housing and a base housing, defining a cavity therebetween for one or more lighting elements and power elements providing to the lighting elements whereby the base housing includes a reversible attachment element for securing and releasing the accessory to a mask or costume, the top housing and the base housing reversibly contacting together to permit selective electrical connection between the one or more lighting elements and the one or more power elements and to provide activation of the one or more lighting elements or deactivation.

18 Claims, 4 Drawing Sheets

DETACHABLE ILLUMINATING COSTUME ACCESSORY

TECHNICAL FIELD

The present invention involves one or more detachable illuminating costume accessories, preferably mask accessories, such as a pair of light transmitting elements configured as eyes for a face mask, each light element capable of reversible attachment to the mask and reversible light activation for use in face masks and costumes.

BACKGROUND OF THE INVENTION

For holidays and occasions like Halloween, children will often go out at night, such as for trick-or-treating. Parties, too, celebrate the holiday, and there are other times that face masks and costumes are worn. For example, masquerade parties, festivals, Carnivale, Purim, etc. Many children and adults seek to present as something or someone highly unusual, sometimes scary. Having a costume or face mask with illuminating eyeballs would likely be favorably received by both the wearer/buyer and the observer(s). However, most costumes do not have any illuminating features, especially face masks, and those that do usually have a wired power pack connected to the lighting elements and extending down the costume to be placed in the wearer's pocket or otherwise affixed to the wearer's clothing. That could be heavy and cumbersome. Moreover, in these instances, the illuminating feature is typically fixed to the mask or costume. There is a need for small, self-contained lighting elements for use in the eye sockets of masks and in other areas of costumes. These illuminated eyeball-like elements need to be capable of easy removal and substitution as well as activation. The present invention solves these needs and others.

SUMMARY OF THE INVENTION

In general, in one aspect, the invention features a detachable illuminating accessory for use in a mask or costume, the detachable illuminating accessory preferably looking like a three-dimensional eyeball with a translucent layer and light on its inside. The eyeball includes a top portion housing one or more lighting elements and a base portion including a reversible attachment element and housing one or more power elements (a small disc-like battery) where the top portion is configured to reversibly contact the base portion at a point sufficient to permit connection between the one or more lighting elements and the one or more power elements and activation of the one or more contained lighting elements.

Implementations of the invention may include one or more of the following features. The detachable illuminating accessory may further include a spring configured to connect the one or more lighting elements (LEDs) and the one or more power elements (batteries). The one or more power elements may be one or more lithium batteries. The one or more lighting elements may include white or another color of LED for lighting. An exterior of the top portion of the housing may be transparent but is preferably translucent plastic and colored. The exterior of the top portion may have the appearance of an eye including a cornea, a pupil and also blood lines. The one or more lighting elements may include colored lighting, and an exterior of the top portion may be translucent, transparent or clear. The reversible attachment element serving to connect the eye element housing to the face mask and to allow for easy removal from the eye socket may be a VELCRO® fastening element configured to attach to a corresponding or mating VELCRO® fastening receiving element on the mask or costume by the latter preferably located within the cavity of the eye ball socket. In this way, the eye ball housing can be activated first, by the intended wearer, by rotating one part of the rear of the housing can be easily placed within the socket. The top portion housing with respect to the other, making electrical contact between the LED(s) and the contained battery and then the eye ball housing cab be slid or placed in the socket of the face mask to present the desired illuminated eyeball to great effect. The base portion of the housing may be configured for a twist- or screw-top connection such that the top portion is twisted or screwed onto the base portion for reversibly contacting to the point sufficient to permit connection between the one or more lighting elements and the one or more power elements and activation of the one or more lighting elements. When the housing is activated for LED illumination, it is placed by thrusting the rear of the housing into the eye ball socket such that the VELCRO® on the rear of the housing contacts and secures the same with the VELCRO® held on the base of the cavity forming the eye ball socket of the face mask. Other configurations of the eyeball and the holding socket can be created and used on a costume.

In general, in another aspect, the invention features a mask including one or more reversible attachment receiving elements and one or more detachable illuminating accessories, where a detachable illuminating accessory includes a top portion housing one or more lighting elements and a base portion including a reversible attachment element and housing one or more power elements, where the top portion is configured to reversibly (generally by simple screwing one portion with respect to the other) contact the base portion at a point sufficient to permit connection between the one or more lighting elements and the one or more power elements and activation of the one or more lighting elements, and where the one or more detachable illuminating accessories (the eyeballs) are configured to reversibly attach to the one or more reversible attachment receiving elements (the eyeball sockets of the face mask, in the preferred embodiment).

Implementations of the invention may include one or more of the following features. The detachable illuminating accessory (the eyeball) may further include an internal spring configured to connect the one or more lighting elements (LEDs) and the one or more power elements (batteries). The one or more power elements may be one or more lithium batteries. The one or more lighting elements may include white or colored lighting. An exterior of the top portion of the viewable housing for the components may be colored. The exterior of the top portion of the housing may have the appearance of an eye. The one or more lighting elements may include colored lighting, and an exterior of the top portion of the housing may be transparent or clear. The reversible attachment element may be a VELCRO® fastening element configured to attach to a corresponding VELCRO® fastening receiving element of the one or more reversible attachment receiving elements, the sockets for the eyeball (located on the face mask or even at unusual or different locations of a costume). The top portion of the housing and the base portion may be configured for a twist- or screw-top connection such that the top portion is twisted or screwed onto the base portion for reversibly contacting to the point sufficient to permit electrical connection between the one or more lighting elements and the one or more power elements and thereby result in activation of the one or more lighting elements. The one or more reversible attachment receiving elements may be two reversible attachment receiving elements, and the one or more detachable illuminating accessories may be two paired eyeballs (or even one for a cyclops or more eyeballs) acting as detachable illuminating accessories. The mask may further include at least one eye hole opening or deep socket disposed in the face mask, adjacent to the one or more reversible attachment receiving elements.

DETAILED DESCRIPTION OF THE PREFERRED EMBODIMENTS AND THE DRAWINGS

Figure 1A:
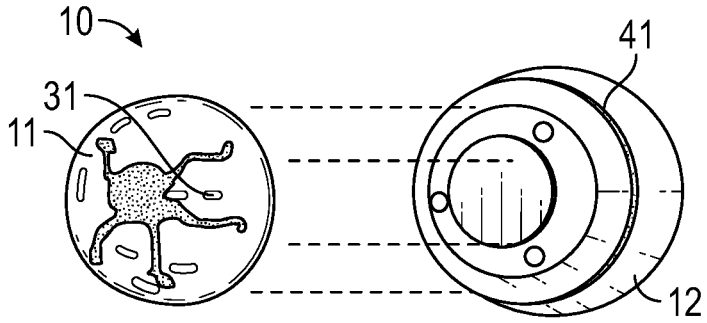
FIG. 1A illustrates a schematic and exploded illustration of a detachable illuminating face mask element (an eyeball) according to one embodiment of the present invention.

The present invention is directed to a face mask element that may reversibly attach to the face mask and reversibly (turn on and off) illuminate. In one example of the present invention, the face mask elements have the appearance of a set of bulging eyeballs. Such an eye-shaped mask element 10 may attach to the mask 1 at a region 20*a* and 20*b* representative of the eye sockets of the mask's depicted face. A mask element taking the form of a bulging eyeball 10 is only one embodiment of the present invention, and the mask element of the present invention may take the form of any costume or face mask component that may be reversibly attached to the costume component and activated and deactivated, i.e., turned on and off and on again, etc. These components can be easily removed, replaced, re-installed, illuminated and turned "off," with additional forms including other facial or costume body features.

The mask element may be reversibly attached to the face mask or costume by any industry-accepted reversible attachment mechanism, including, but not limited to, VELCRO®, with hooks and corresponding loops, snaps, button and button hole, zipper, adhesive, and the like. In the embodiment in which VELCRO® fastening means are utilized, a first half of the VELCRO® fastening means may be disposed by adhesive on a back side of the housing for the face mask element (the eyeball being the preferred embodiment) and a corresponding and mating second half of the VELCRO® fastening means (the first could be the loops and the second the hooks, or vice versa) may be disposed on or in the desired regions 20*a* and 20*b* of the mask or costume which holds the bulging eyeball, i.e., the eye sockets. One can easily appreciate the present invention from a review of the Figures with the region representative of the eye sockets 20*a* and 20*b* of the mask 1, depicted as a face, such that when the first and second halves of the VELCRO® fastening means are brought together, the face mask elements 10 are reversibly affixed to the mask or costume at the desired location—in the eye sockets.

The face mask elements 10 (preferably resembling an eyeball) may be reversibly turned "on" and "off" or illuminated by any industry-accepted reversible illumination or activation mechanism, including, but not limited to, twist/screw top relative to a battery holding chamber, a slide switch, a click push or tap mechanism, a darkness sensor, and the like. In the embodiment in which a twist-screw top is utilized, a first part or the bulging housing 11*a* and 11*b* of the mask elements may include one or more LED lights (not individually shown), wire connected to a central metal circular piece 32 which has a spiral battery spring 34 connected thereto. (See FIG. 1). The base housing 12*a* and 12*b* for the battery holding chamber for the mask element 10 may include one or more battery elements 42 (e.g., lithium batteries) with an electrical metallic connector element 50. This piece is in electrical contact with the bottom of the battery (the positive side) and then extends up the side edge of the battery(ies) and towards the outer ring 36 of the plate, such that when the first part or housing is sufficiently twisted or screwed (the first part 11 has female interior threads and the second part has exterior male threads) onto the second part or the base member 12, the battery spring 34 and the electrical connector 50 make sufficient electrical contact (complete the circuit) with the one or more battery elements 42, thereby activating the one or more LED lights. The eyeball or face mask element will turn on and off in a manner quite similar to a conventional flashlight which turns on and off by simple screwing of one part of the housing with respect to another part such that the battery spring and electrical connector are (either or both) in or no longer in sufficient electric contact with the one or more battery elements. The first part 11 may still be attached (i.e., twisted onto) to the second part 12 and the lighting not be activated, as long as there is no longer sufficient contact between the LEDS, inner metal ring 32, spring 34, battery(ies) 42 and electrical connector 50 back to the outer ring and then to the other wire leads of the LEDs. In this way, the first part 11 is never fully removed by unscrewing (except to exchange LEDs or the battery) from the second part 12, keeping the mask element housing intact for easy turning on and off. However, the first part may be capable of being fully removed from the second part so as to access the battery elements and the LEDs for replacement.

The lights in the mask element may be white, clear or colored. In the embodiment in which the lights are white, a front exterior portion of the housing for the mask element may be a certain color (by paint or otherwise) such that when the interior LED lights are activated, the mask element appears illuminated in that color. For example, the front exterior portion of the mask elements, the eyeballs, may be painted with red streaks, such as by the application of red paint, and upon activation, the mask element is illuminated in a glowing red color. Relatedly, the front exterior portion of the mask element may be in the appearance of a red eye, such as by the application of red and black paint/streak lines on a clear or translucent front of the housing such that upon activation, the mask element is illuminated so as to appear as a glowing red or blood-shot eye. In the embodiment in which the lights are colored, a front exterior portion of the mask element may be clear, translucent or transparent such that the color of the colored lights is visible or can be merged to a visual effect with the transmittivity of the plastic and painting on the exterior of the housing. Preferable colors for the LEDs include red, yellow, and green. The present invention also envisages interchangeability of colors in the mask elements, e.g., a mask with a first green eye-shaped mask element and a second red eye-shaped mask element, permitting for further customization. The LEDs can be connected to a small IC board within the housing such that they may blink, change which LED is illuminated, be sequenced, etc.

The mask itself may be a half mask, in which the wearer's bottom face portion is exposed, or a full mask, in which the wearer's entire face is covered, except for appropriate viewing (eye slots 40 are provided for the wearer's actual eyes to see through the face mask for safety) and mouth and/or nose breathing openings. The face mask elements of the present invention are simulations of the eyes of the face mask but should not interfere with the actual viewing and breathing openings (eye slits and apertures) of the mask. In the embodiment in which bulging eye-shaped mask elements held in eye sockets are utilized, the mask should be able to permit viewing through eye slits or openings 40 in the mask, and the eye-shaped bulging mask elements should be disposed adjacent to such eye openings or slits.

Figure 1B:
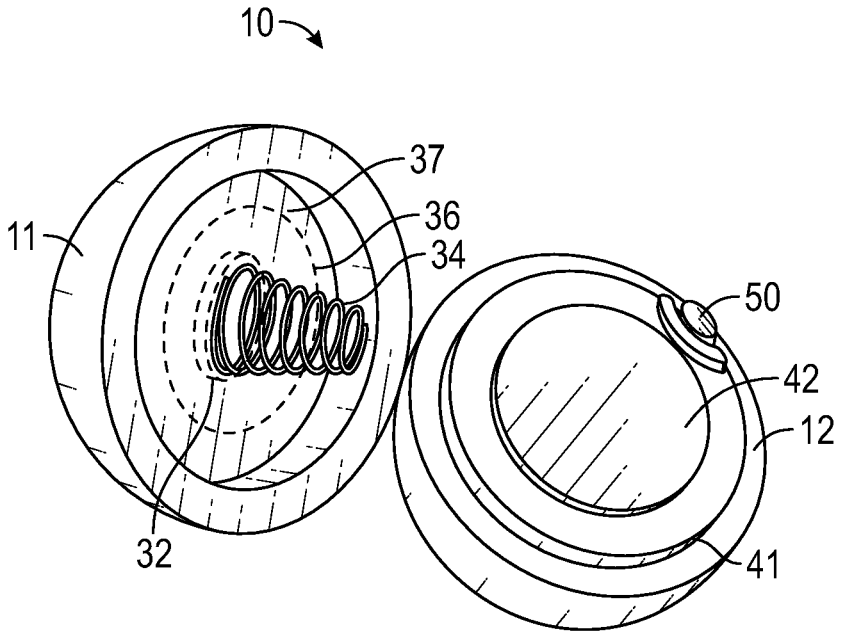
FIG. 1B is an open illustration of a detachable illuminating face mask element (an eyeball) according to one embodiment of the present invention and shows electrical and mechanical interior of the eyeball, when the front is unscrewed from the rear.

FIG. 1A shows the components of a detachable illuminating mask element (an eyeball) of the present invention, in particular, a mask element or eyeball 10. Mask element 10 includes a top outwardly bulging first housing 11 and a flat rear, base or second housing 12. The two housings connect together and form a cavity for the electrical components of the eyeballs. Top housing 11 reversibly attaches (in this case by screwing threads of the top housing onto and off of the base housing) onto base housing 12 by a twist/screw top mechanism (interior female threads are provided on the open edge of the top housing 11 and corresponding exterior male threads on the top outside edge of the base element 12). The threads are located around their outside surfaces. In this embodiment of the present invention, top housing 11 is configured in the appearance of a red and "blood shot" eye, such as by the application of red and black paint onto an otherwise clear bulging eye chamber. In certain embodiments of the present invention, the back side of base 12 includes a reversible attachment mechanism for reversibly attaching element or eyeball 10 to an eye socket 20*a* of a face mask 1 or receiving location on a costume. Within mask element 10 are sufficient interconnected elements or means for reversibly controlling the electrical illumination of the mask element 10, such as one or more LED lights, one or more battery elements, and an on and off device, preferably a battery spring, a metal support plate and a finger like electrical connector. A small integrated circuit can also be provided within the eyeball housing 11 and/or 12 to vary the effects of the LEDs, over time, e.g., switching on and off, changing colors and/or intensity, etc.

As can be appreciated, the top housing 11 is screwable onto the bottom base 12 and then the base 12 is held, removably into the eye socket 20*a* (and the Velcro® secured thereto) by the corresponding Velcro® on the flat rear of the base securing to the corresponding Velcro® of the eye socket area of the mask 1. In this manner, the mask element can be secured to and removed from the eye ball socket 20*a* of the mask 1.

Also, as should be appreciated, the mask element 10 comprises an outwardly bulging substantially transparent or translucent first element 11 which mechanically couples to the base member 12 via screw threads, male and female, respectively. The bulging element 11 contains the LEDs and they are electrically connected to a small metal plate with an inner conductive circle 32 having one end of the LEDs connected thereto, a separating or insulative ring 36 which surrounds the conductive circle 32 and is insulative and an outer ring of metal 37 which is secured to the other end of the LEDs, all contained within the housing 11. The thin metal plate is slightly recessed into the element 11 by the depth of the female threads. Preferably, the exterior of the element 11 and/or that of base member 12 are provided with knurling so as to allow for easy twisting of the same vis a vis one another, to turn the LEDs (and make and remove mechanical and electrical connection) on and off. The LED's are in series and have one end or terminal wire electrically secured to the inner circle 32 and the other lead or terminal wire connected to the outer metal ring 37 of the plate. A helical spring 34 is secured to the rear of the circle 32 and the spring 34 extends toward the base or second element 12. The free end of the helical spring is meant to make electrical contact with the small button pole (usually negative) of the one or more batteries 42, connected in series, and maintained in the base member 12. The base member can be sufficiently deep to house two button batteries (in series) therein.

In the preferred embodiment, the coupling of the top housing 11 to the base member 12 further comprises a small rubber O ring 41 (see FIG. 1A) to seal the interior of the eyeball 10 from water.

The base member 12 is disc-like and comprises a rear flat outside or back surface to which one element of the Velcro® attachment means is secured. Likely that is done by simple adhesive. The interior of the base member 12 is a chamber provided for holding the one or more button batteries. Located in electrical connection with the flat or back/rear side of the bottom battery, usually the positive pole, is a small piece of metal 50, in a U-shape, which then extends up one edge of the battery(ies) and extends upwardly toward the outer ring 37 of the metal plate of the housing or top member 11. When the screw threads of the housing 11 are secured into the screw threads of the base member 12, a complete electrical connection is made extending between one end of the leads of the LEDs, to the inner circle 32 of the metal plate, to the spring 34, to the negative side of the battery 42, to the positive side of the battery(ies) 42 to the small metallic connector 50 and then extending back to the outer ring 37 of the thin plate to thereby complete the circuit (as the outer ring holds the second wire or terminal ends of the LEDs). This allows the LEDs to turn on. Correspondingly, unscrewing, even partially, the top housing 11 from the base member 12 will cause a loss of electrical connection between the small metallic piece 50 beneath the battery 42 and extending towards the outer ring 37 of the metal piece of the top member 11 to turn the LEDs off. Other mechanisms can be used as are available in simple and small flashlights. Twisting the front member 11 and tightening the screw connection threads tends to turn the LEDs "on" while untwisting the front member 11 vis a vis the base member 12 tends to remove the complete electrical connection (by separating the metal piece 50 from the outer ring 37) which will turn the LEDs "off."

Figure 2:
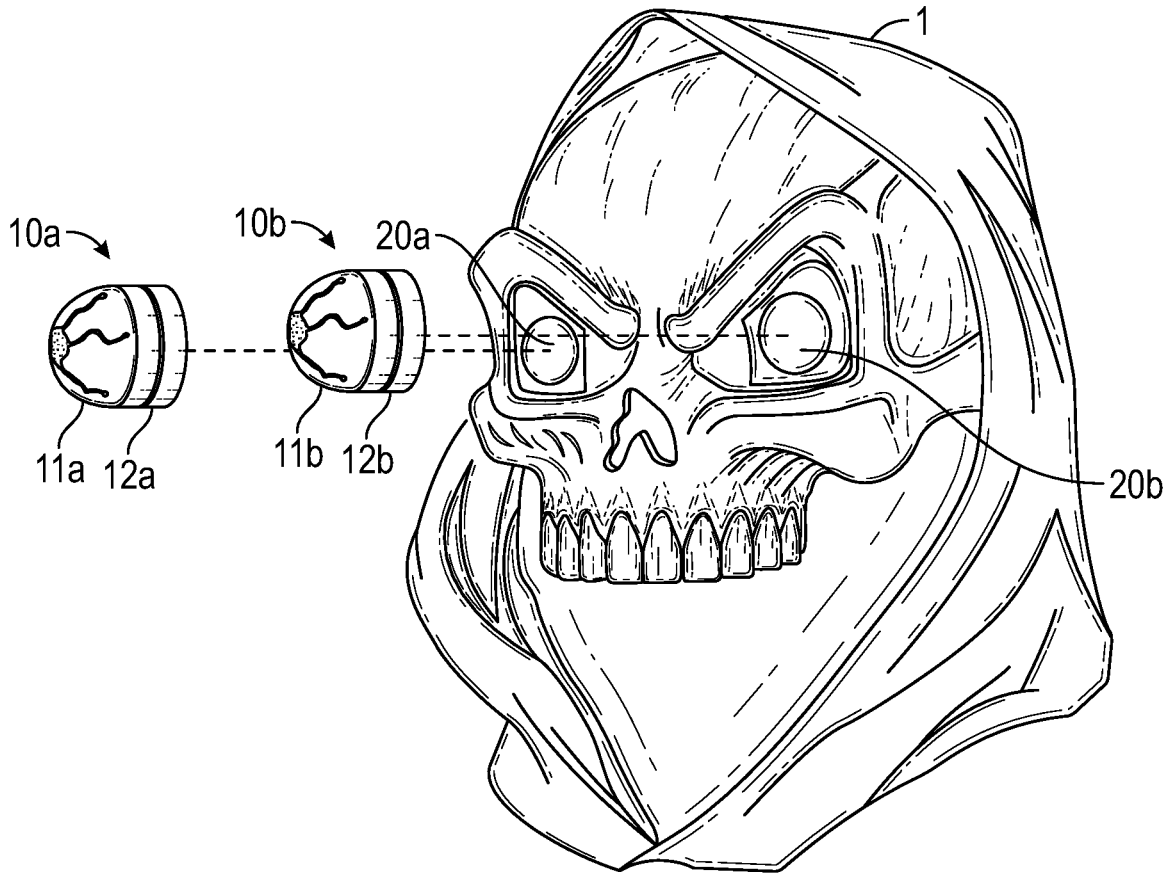
FIG. 2 illustrates a schematic and exploded illustration of a face mask having detachable illuminating mask elements (eyeballs) according to one embodiment of the present invention.

FIG. 2 shows the components of a mask of the present invention that has detachable illuminating mask elements 10, in particular mask 1 having a first mask eye ball element

10*a* and a second or eyeball mask element 10*b*. First mask element 10*a* includes a first top or housing 11*a* and a first base or mating housing 12*a*, and second mask element 10*b* includes a second top housing 11*b* and a second mating base housing 12*b*. Mask elements 10*a* and 10*b* may be configured in a similar manner to the mask element embodied of FIGS. 1A and 1B, both with respect to the reversible (on and off) illumination and the reversible attachment (secured to the face mask and removable as desired). Accordingly, mask 1 includes a first attachment point 20*a* (an eyeball socket) and a second attachment point 20*b* (preferably another eye ball recessed socket) for attachment of mask elements 10*a* and 10*b*, respectively. This may be achieved by disposing a first half of the VELCRO® fastening means (say the loops) on the back sides of housing bases 12*a* and 12*b*, respectively, and disposing a corresponding second half of the VELCRO® fastening means (the hooks) on mask 1 at attachment points 20*a* and 20*b* (the eyeball sockets), respectively, such that when the first and second halves of the VELCRO® fastening means are brought together, mask elements 10*a* and 10*b* are reversibly affixed to mask 1. Attachment points 20*a* and 20*b* are disposed adjacent to eye slits or openings 40 in mask 1 such that mask 1 permits acceptable actual viewing by the wearer when worn, even in instances where mask 1 includes mask elements 10*a* and 10*b* attached thereto.

Figure 3A:
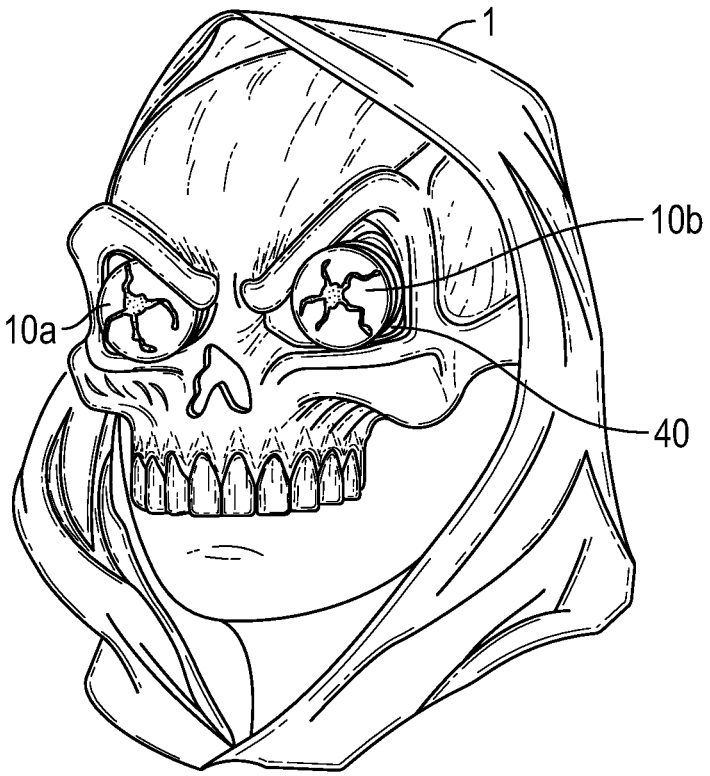
FIG. 3A illustrates a front perspective view illustration of the face mask having detachable illuminating mask elements of FIG. 2, as worn by a user in an inactivated state.
Figure 3B:
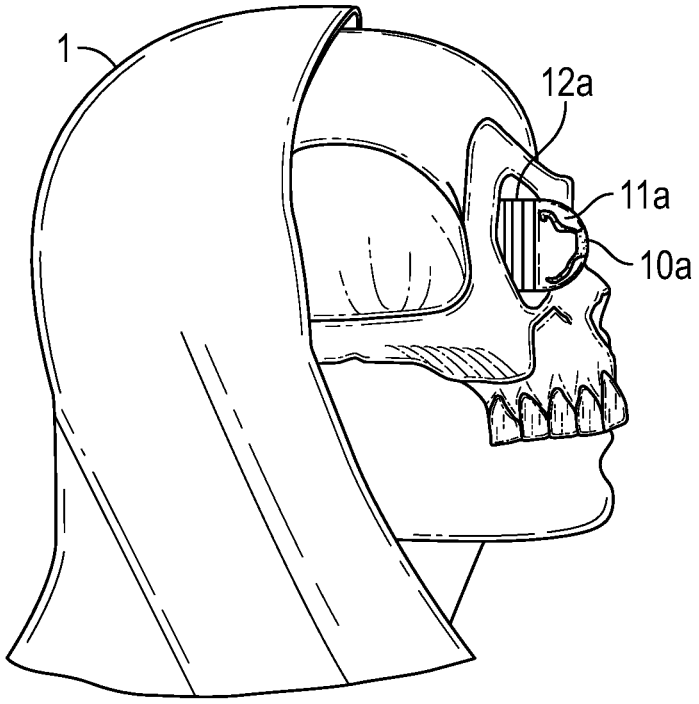
FIG. 3B illustrates a side view illustration of the face mask having detachable illuminating mask elements (eyeballs) of FIG. 2, as worn by a user in an inactivated state.
Figure 4A:
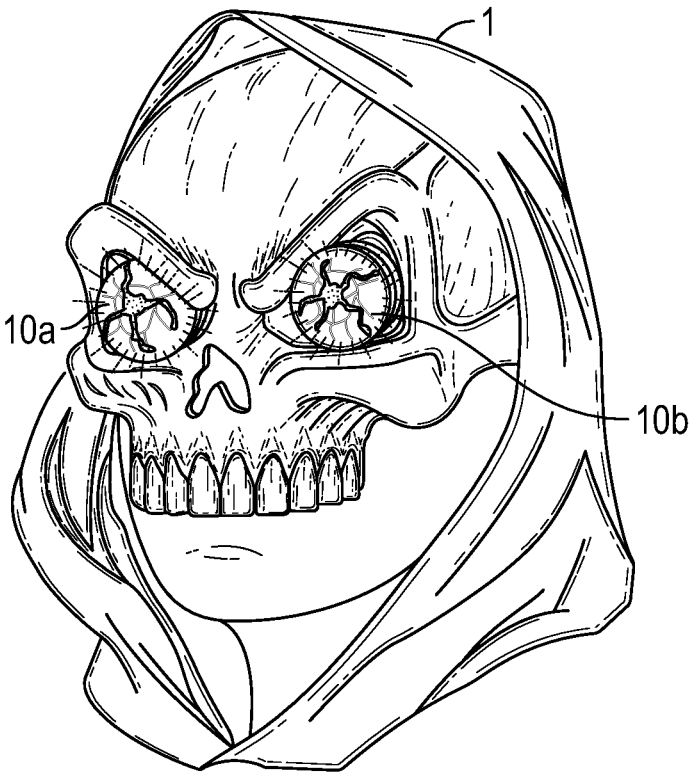
FIG. 4A illustrates a front perspective view illustration of the face mask having detachable illuminating mask elements (eyeballs) of FIG. 2, as worn by a user in an activated state.
Figure 4B:
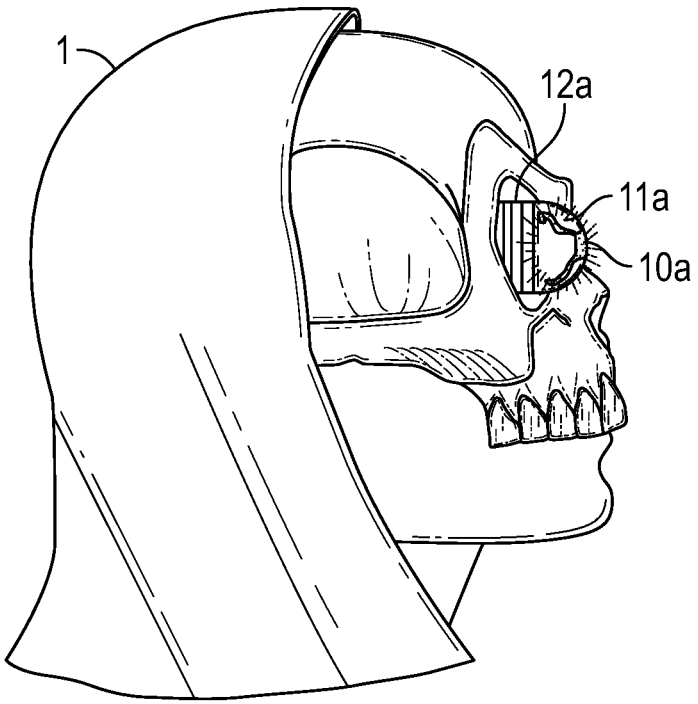
FIG. 4B illustrates a side view illustration of the face mask having detachable illuminating mask elements (eyeballs) of FIG. 2, as worn by a user in an activated state.

FIGS. 3A and 3B are varying views of mask 1 in which mask elements 10*a* and 10*b* are attached thereto but in an inactivated state. In particularly, top housings 11*a* and 11*b* have not been sufficiently twisted or screwed onto bases 12*a* and 12*b* such that illumination activation and a complete electrical circuit is not present. FIGS. 4A and 4B are varying views of mask 1 in which mask elements 10*a* and 10*b* are attached thereto and in an activated or illuminated state as a consequence of complete electric circuit between the LEDs, the plate, the circle, the spring, the battery(ies) and the metallic finger 50. In particularly, top housings 11*a* and 11*b* have been sufficiently twisted or screwed with respect and onto base housings 12*a* and 12*b* such that illumination activation occurs, which produces the glowing red or blood shot eye effect of this embodiment. The housings are made of thin preferably clear or translucent plastic and are mating cavities, holding the LEDs and the electrical/mechanical switching mechanism (outer and inner rings, spring, batteries and metal finger). The edges of the housings are provided with mating male and female screw threads for mating engagement.

The embodiments and examples above are illustrative, and many variations can be introduced to them without departing from the spirit of the disclosure or from the scope of the invention. For example, elements and/or features of different illustrative and exemplary embodiments herein may be combined with each other and/or substituted with each other within the scope of this disclosure. Therefore, it is intended that the invention not be limited to the particular embodiments disclosed, but that the invention will include all embodiments falling within the scope of the invention and the claims. For a better understanding of the invention, its operating advantages and the specific objects attained by its uses, reference should be had to the accompanying drawings and descriptive matter, in which there is illustrated a preferred embodiment of the invention.

What is claimed is:

1. A detachable illuminating accessory for use in a face mask or costume, the detachable illuminating accessory comprising:

a top housing; and a base housing including a reversible attachment element for selective securing the same to said face mask or costume, said base housing mating with said top housing to define a container for one or more lighting elements and one or more power elements;

said detachable illuminating accessory further comprising a selective switching mechanism for providing and removing electrical connection between said one or more lighting elements and said one or more power elements, wherein said selective switching mechanism comprises said top housing being screw threaded to said base housing to reversibly contact the top housing with the base housing at a point sufficient to permit connection between the one or more lighting elements and the one or more power elements and activation of the one or more lighting elements, and a spring configured to connect the one or more lighting elements and the one or more power elements.

2. The detachable illuminating accessory of claim 1, wherein the one or more power elements are one or more lithium batteries.

3. The detachable illuminating accessory of claim 1, wherein the one or more lighting elements include an LED providing white lighting.

4. The detachable illuminating accessory of claim 1, wherein an exterior of the top housing is translucent plastic.

5. The detachable illuminating accessory of claim 1, wherein an exterior of the top housing is colored.

6. The detachable illuminating accessory of claim 5, wherein the exterior of the top housing has the appearance of an eyeball.

7. The detachable illuminating accessory of claim 1, wherein the one or more lighting elements are driven by an integrated circuit within said top housing or said base housing for a visual effect other than merely constant illumination.

8. The detachable illuminating accessory of claim 1, wherein the reversible attachment element is a fastening element configured to attach to a corresponding and mating fastening receiving element on the mask or costume.

9. The detachable illuminating accessory of claim 1, wherein said detachable illuminating accessory is selectively housed in a socket of said face mask or said costume.

10. The detachable illuminating accessory of claim 1, wherein the top housing and the base housing define a cavity therebetween and are provided with a twist- or screw-top mating connection such that the top housing is twisted or screwed onto and with respect to the base housing for reversibly contacting the housings to the point sufficient to permit connection between the one or more lighting elements and the one or more power elements and to provide activation of the one or more lighting elements.

11. A mask comprising:

one or more reversible attachment receiving elements allowing for securing to and removal from said mask of one or more detachable illuminating accessories, wherein the detachable illuminating accessory comprises:

a top housing;

a base housing which, with said top housing, defines a cavity for one or more lighting elements and one or more power elements, said detachable illuminating accessory further comprising a reversible attachment element for securing the same and allowing removal of said detachable illuminating accessory from said mask in cooperation with said one or more reversible attachment receiving elements of said mask; and a spring configured to selectively electrically connect the one or more lighting elements and the one or more power elements when said top housing is at a point sufficient to permit electrical connection between the one or more lighting elements, wherein the top housing is configured to reversibly contact the base housing at a point sufficient to permit connection between the one or more lighting elements and the one or more power elements and activation of the one or more lighting elements.

12. The mask of claim 11, wherein the one or more power elements are one or more lithium batteries.

13. The mask of claim 11, wherein the one or more lighting elements include white LEDs.

14. The mask of claim 11, wherein an exterior surface of the top housing is colored.

15. The mask of claim 11, wherein the one or more lighting elements is varied in illumination effect by an integrated circuit contained within the cavity defined between said top housing and said base housing, said integrated circuit in electrical connections with said one or more lighting elements and said one or more power elements.

16. The mask of claim 11, wherein the reversible attachment element of the mask is a hook and loop fastening element configured to attach to a corresponding hook and loop fastening receiving element of the one or more reversible attachment receiving elements.

17. The mask of claim 11, wherein the top housing and the base housing are configured for a twist- or screw-top connection such that the top housing is twisted or screwed onto the base housing for reversibly contacting to the point sufficient to permit connection between the one or more lighting elements and the one or more power elements and activation of the one or more lighting elements.

18. The mask of claim 11, further comprising at least one eye slot opening disposed adjacent to the one or more reversible attachment receiving elements.

* * * * *